US010883514B2

(12) United States Patent
Nakatani et al.

(10) Patent No.: US 10,883,514 B2
(45) Date of Patent: Jan. 5, 2021

(54) BLOWER FAN

(71) Applicant: Rinnai Corporation, Aichi (JP)

(72) Inventors: Tatsuyoshi Nakatani, Aichi (JP); Takuya Iwasaki, Aichi (JP)

(73) Assignee: Rinnai Corporation, Aichi (JP)

( * ) Notice: Subject to any disclaimer, the term of this patent is extended or adjusted under 35 U.S.C. 154(b) by 133 days.

(21) Appl. No.: 16/270,362

(22) Filed: Feb. 7, 2019

(65) Prior Publication Data

US 2019/0368503 A1 Dec. 5, 2019

(30) Foreign Application Priority Data

May 29, 2018 (JP) ..... 2018-102526

(51) Int. Cl.

| | |
|---|---|
| ***F04D 29/26*** | (2006.01) |
| ***F04D 29/66*** | (2006.01) |
| ***F04D 25/06*** | (2006.01) |
| ***F04D 17/08*** | (2006.01) |
| ***F04D 25/08*** | (2006.01) |
| ***F04D 29/20*** | (2006.01) |

(52) U.S. Cl.

CPC ..... *F04D 29/263* (2013.01); *F04D 17/08* (2013.01); *F04D 25/06* (2013.01); *F04D 25/08* (2013.01); *F04D 29/668* (2013.01); *F04D 29/20* (2013.01)

(58) Field of Classification Search

CPC ..... F04D 25/06; F04D 29/263; F04D 29/281; F04D 29/668; F04D 17/08; F04D 25/08; F04D 29/20

USPC ..... 417/363, 423.1

See application file for complete search history.

(56) References Cited

U.S. PATENT DOCUMENTS 3,084,963 A * 4/1963 Beehler ..... F04D 29/263 403/226

6,190,134 B1 * 2/2001 Hudson ..... F04D 29/263 415/216.1

FOREIGN PATENT DOCUMENTS

JP S63-029126 A 2/1988

WO 2016/013096 A1 1/2016

* cited by examiner

*Primary Examiner* — Alexander B Comley

(74) *Attorney, Agent, or Firm* — Nakanishi IP Associates, LLC

(57) ABSTRACT

A blower fan including an impeller easily mounted on the rotational shaft of a motor generates less noise. The impeller is mounted on the rotational shaft of the motor using a fastener with an elastic vibration isolator and a washer in between. The washer has a predetermined shape including radial projections from a circumference about a central receiving hole. The vibration isolator has the predetermined shape larger than the predetermined shape of the washer, and has a first recess having the predetermined shape on its top surface to receive the washer fittingly. The impeller has a second recess having the predetermined shape on its top surface to receive the vibration isolator fittingly. The vibration isolator thus separates the impeller mounted on the rotational shaft from the washer in both the axial and rotational directions of the motor to reduce vibrations in both directions propagating to the impeller, generating less noise.

12 Claims, 5 Drawing Sheets

BLOWER FAN

BACKGROUND OF INVENTION

Field of the Invention

The present invention relates to a blower fan that blows air by rotating an impeller mounted on a rotational shaft of a motor.

Background Art

Various blower fans are known for blowing air with an impeller rotated by a motor, and such fans are used widely. The impeller of a blower fan has a through-hole along the axis of rotation, through which the rotational shaft of the motor having for example a thread on its distal end is placed. The impeller is mounted on the rotational shaft protruding from the through-hole with a fastener such as a nut. The impeller mounted in this manner can be easily centered on the rotational shaft of the motor when the through-hole has an inner diameter suitable for the rotational shaft.

However, the rotational shaft of the motor and the impeller are in direct solid contact (or indirect solid contact with a nut) with this method, thus generating noise from vibrations of the rotating motor propagating to the impeller. The vibrations of the rotating motor include slight axially reciprocating vibrations of the rotational shaft of the motor (hereafter, axial vibrations) and vibrations caused by slight changes in the torque of the motor per rotation of the rotational shaft (hereafter, rotational vibrations). The axial vibrations may be reduced by placing rubber washers on the two axial ends of the impeller mounted on the rotational shaft of the motor (Patent Literature 1).

The axial and rotational vibrations may both be reduced by a vibration isolator placed in the through-hole of the impeller between the rotational shaft of the motor and the impeller (Patent Literature 2). The vibration isolator used with this method includes a metal inner cylinder and a metal outer cylinder separated by a rubber material between them. The inner cylinder has a through-hole along its central axis, and the outer cylinder has a polygonal cross section. The vibration isolator has a polygonal prism profile with a through-hole along the central axis. The impeller has a through-hole with the same polygonal shape as the vibration isolator along the central axis. The vibration isolator is pressed in the through-hole of the impeller. To mount the impeller on the rotational shaft of the motor, the rotational shaft of the motor is placed through the through-hole of the vibration isolator to receive a fastener such as a nut on its distal end protruding from the through-hole. Although having the inner cylinder of the vibration isolator and the rotational shaft of the motor in solid contact with each other, and the outer cylinder of the vibration isolator and the impeller in solid contact as well, the inner and outer cylinders in the vibration isolator are separated by the rubber material. This method thus prevents the axial and rotational vibrations of the motor from propagating to the impeller.

CITATION LIST

Patent Literature

Patent Literature 1: Japanese Unexamined Patent Application Publication No. 63-29126

Patent Literature 2: WO 2016/013096

However, the above known techniques insufficiently reduce the noise of the blower fan, because of the following reasons. The technique in Patent Literature 1 surely does not allow the axial vibrations of the motor to propagate to the impeller, but allows the rotational vibrations of the motor to propagate to the impeller, and thus insufficiently reduces the noise of the blower fan. The technique in Patent Literature 2 uses a thick rubber layer fitted between the outer and inner cylinders, so the thick rubber layer easily causes deviation (misalignment) between the rotational shaft of the motor and the central axis of the impeller. With the vibration isolator, such misalignment produces even more noise. These known techniques thus insufficiently reduce the noise of the blower fan.

In response to the above issue, one or more aspects of the present invention are directed to a blower fan including an impeller easily mounted on a rotational shaft of a motor, and generating less noise.

SUMMARY OF INVENTION

A blower fan according to one aspect of the present invention has the structure described below. The blower fan includes an impeller having a through-hole along a central axis, a motor including a rotational shaft placed through the through-hole, a washer receiving the rotational shaft protruding from the through-hole, and a fastener mounted on the rotational shaft and pressing the impeller through the washer to mount the impeller on the rotational shaft. The blower fan blows air by rotating the impeller with the motor. The washer is a plate having a predetermined shape including a plurality of projections radially extending from a circumference about a receiving hole through which the rotational shaft is placed. The washer and the impeller are separated by an elastic vibration isolator. The vibration isolator has the predetermined shape larger than the predetermined shape of the washer, and has a first recess having the predetermined shape on a top surface of the vibration isolator to receive the washer in a fitting manner. The impeller has a second recess having the predetermined shape on a top surface of the impeller to receive the vibration isolator in a fitting manner.

In the blower fan according to the above aspect, the impeller is mounted on the rotational shaft of the motor using the fastener, with the vibration isolator and the washer in between. The washer has the receiving hole at the center, through which the rotational shaft of the motor is placed. The washer has the predetermined shape including the plurality of projections radially extending from the circumference about the receiving hole. The vibration isolator is formed from an elastic material, such as a rubber material or a resin material. The vibration isolator has the predetermined shape larger than the predetermined shape of the washer. The vibration isolator has the first recess having the predetermined shape on the top surface to receive the washer in a fitting manner. The impeller has the second recess having the predetermined shape on the top surface to receive the vibration isolator in a fitting manner.

When the impeller is mounted on the rotational shaft of the motor, the vibration isolator is fitted into the second recess of the impeller, and the washer is fitted into the first recess of the vibration isolator. The impeller and the washer thus have the vibration isolator between them in both the axial and rotational directions of the motor. This structure reduces both the axial and rotational vibrations of the motor propagating to the impeller, thus reducing the noise of the blower fan. Moreover, the impeller, which is mounted using the fastener with the vibration isolator and the washer in between, can be centered on the rotational shaft and easily mounted on the rotational shaft of the motor.

In the blower fan according to the above aspect, the washer may have the predetermined shape including the plurality of projections radially extending from the circumference with a radius equal to or greater than two and half times the radius of the receiving hole.

In this case, the washer with the predetermined shape has a longer circumference in contact with the vibration isolator, and thus has a greater area for compressing the vibration isolator to transmit the torque of the motor. This structure transmits a greater torque while applying less stress to the vibration isolator. Thus, the vibration isolator can absorb any greater rotational vibrations in the motor.

In the blower fan according to the above aspect, the impeller may be mounted on the rotational shaft of the motor with the rubber bottom washer placed on the bottom end of the impeller. Thus, the mounted impeller may have its top end supported by the vibration isolator and the bottom end supported by the bottom washer.

This structure reliably prevents the axial vibrations of the motor from propagating to the impeller, thus further reducing the noise of the blower fan.

In the blower fan according to the above aspect, the washer may be polygonal.

The polygonal washer may have corners that firmly press the vibration isolator when rotating together with the motor. This structure reliably transmits the torque of the motor to the vibration isolator, and thus transmits a greater torque to the impeller.

In the blower fan according to the above aspect, the washer may be oval or long oval.

The washer with such a shape will not locally firmly press the vibration isolator when rotating together with the motor. Thus, the rubber vibration isolator can be used over a long period without local wear.

DETAILED DESCRIPTION

Figure 1A:
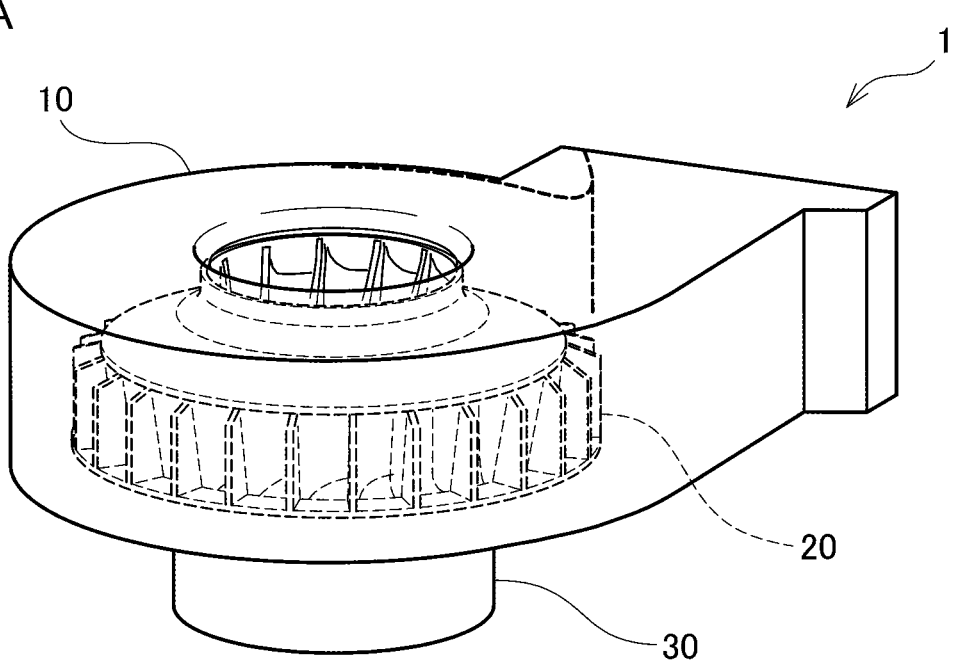
FIGS. 1A and 1B are perspective view and top plan view of a blower fan 1, respectively, according to one embodiment showing its structure.
Figure 1B:
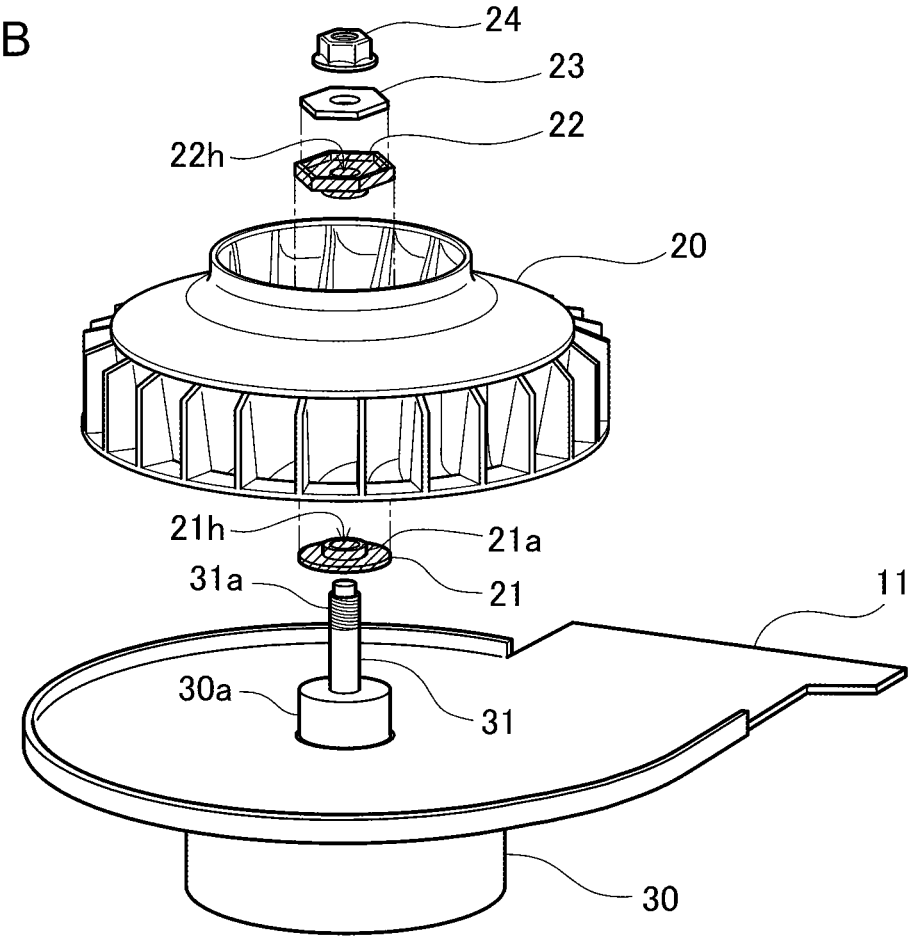

FIGS. 1A and 1B are perspective views of a blower fan 1 according to the present embodiment showing its structure. As shown in FIG. 1A, the blower fan 1 according to the present embodiment includes an impeller 20 accommodated in a body case 10, and a motor 30 mounted externally to the body case 10. The impeller 20 in the body case 10 is rotatable by the motor 30.

FIG. 1B is a diagram describing the impeller 20 being assembled to the motor 30 in the blower fan 1. In FIG. 1B, the upper portion of the body case 10 is not shown. As shown in FIG. 1B, the motor 30 has a protrusion 30*a* extending through the center of a bottom plate 11 of the body case 10, and a rotational shaft 31 extending from the center of the protrusion 30*a*. The rotational shaft 31 has an external thread 31*a* on its upper end. The impeller 20 has a through-hole (not shown) along its central axis. Having its bottom end supported by a bottom washer 21 and its top end supported by a vibration isolator 22, the impeller 20 is mounted on the rotational shaft 31 of the motor 30 placed through the through-hole.

The bottom washer 21 is a circular rubber plate. The bottom washer 21 has a cylindrical fitting protrusion 21*a* at the center of the top surface, and a through-hole 21*h* along the central axis of the fitting protrusion 21*a*. The impeller 20 has a circular recess on the bottom end surrounding the opening of its through-hole (not shown). The bottom washer 21 is mounted on the bottom end of the impeller 20 with the cylindrical fitting protrusion 21*a* fitted into the recess.

The vibration isolator 22 is a polygonal rubber member. The vibration isolator 22 has a central through-hole 22*h*. The shape of the vibration isolator 22 will be described in detail later. The impeller 20 has a recess on the top end surrounding the opening of its through-hole (not shown). The recess has the same polygonal shape as the vibration isolator 22. The vibration isolator 22 is fitted into the polygonal recess and thus is mounted on the top end of the impeller 20. This structure will also be described in detail later. To mount the impeller 20 on the rotational shaft 31 of the motor 30, a washer 23 having the same polygonal shape as the vibration isolator 22 is placed on the top surface of the vibration isolator 22. The washer 23 is fastened with a nut 24, which is screwed with the external thread 31*a* of the rotational shaft 31 protruding through the center of the washer 23. The nut 24 in the present embodiment is an example of a fastener of the present invention. Although the external thread 31*a* on the distal end of the rotational shaft 31 and the nut 24 are used to mount the impeller 20 in the present embodiment, the impeller 20 may be mounted with a different method, such as bonding or swaging.

Figure 2A:
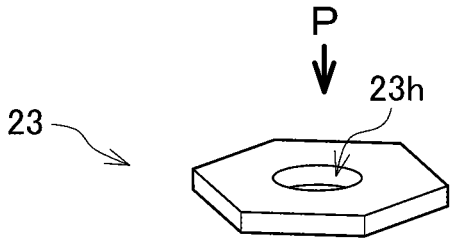
FIGS. 2A and 2B are perspective views of a washer 23 used to mount an impeller 20 to the blower fan 1 according to the embodiment.
Figure 2B:
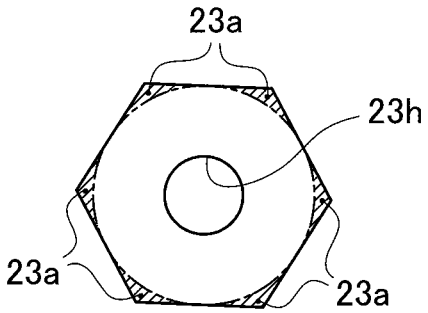

FIGS. 2A and 2B are diagrams describing the detailed shape of the washer 23. FIG. 2A shows the entire shape of the washer 23, and FIG. 2B shows the washer as viewed in the direction of the arrow P in FIG. 2A. As illustrated, the washer 23 is a polygonal (hexagonal in the illustrated example) plate with a central through-hole 23*h*. The through-hole 23*h* is an example of a receiving hole of the present invention. Although the washer 23 is hexagonal in the present embodiment, the washer 23 may be in any other shape that includes multiple projections radially extending from a circumference drawn with a radius equal to or greater than two and half times (or three times in some embodiments) the radius of the through-hole 23*h*. In FIG. 2B, the dot-and-dash line indicates a circumference drawn with a radius three times the radius of the through-hole 23*h*, and the hatched areas are six projections 23*a* radially extending from the circumference drawn with the dot-and-dash line.

Figure 3:
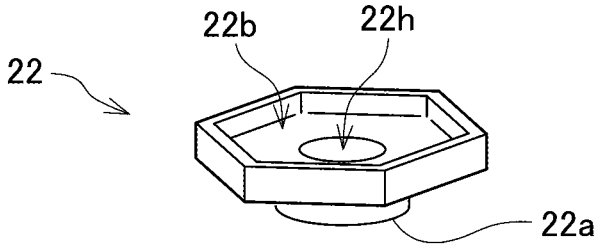
FIG. 3 is a perspective view of a vibration isolator 22 used to mount the impeller 20 to the blower fan 1 according to the embodiment.

FIG. 3 is a diagram describing the detailed shape of the vibration isolator 22. As illustrated, the vibration isolator 22 has substantially the same polygonal (hexagonal in this example) shape as the washer 23, but is larger than the washer 23. The vibration isolator 22 has a downward cylindrical fitting protrusion 22*a* at the center of the bottom surface. The fitting protrusion 22*a* has a through-hole 22*h* along its central axis. The vibration isolator 22 has a first recess 22*b* on the top surface. The first recess 22*b* has the same size and the same polygonal shape as the washer 23.

Figure 4:
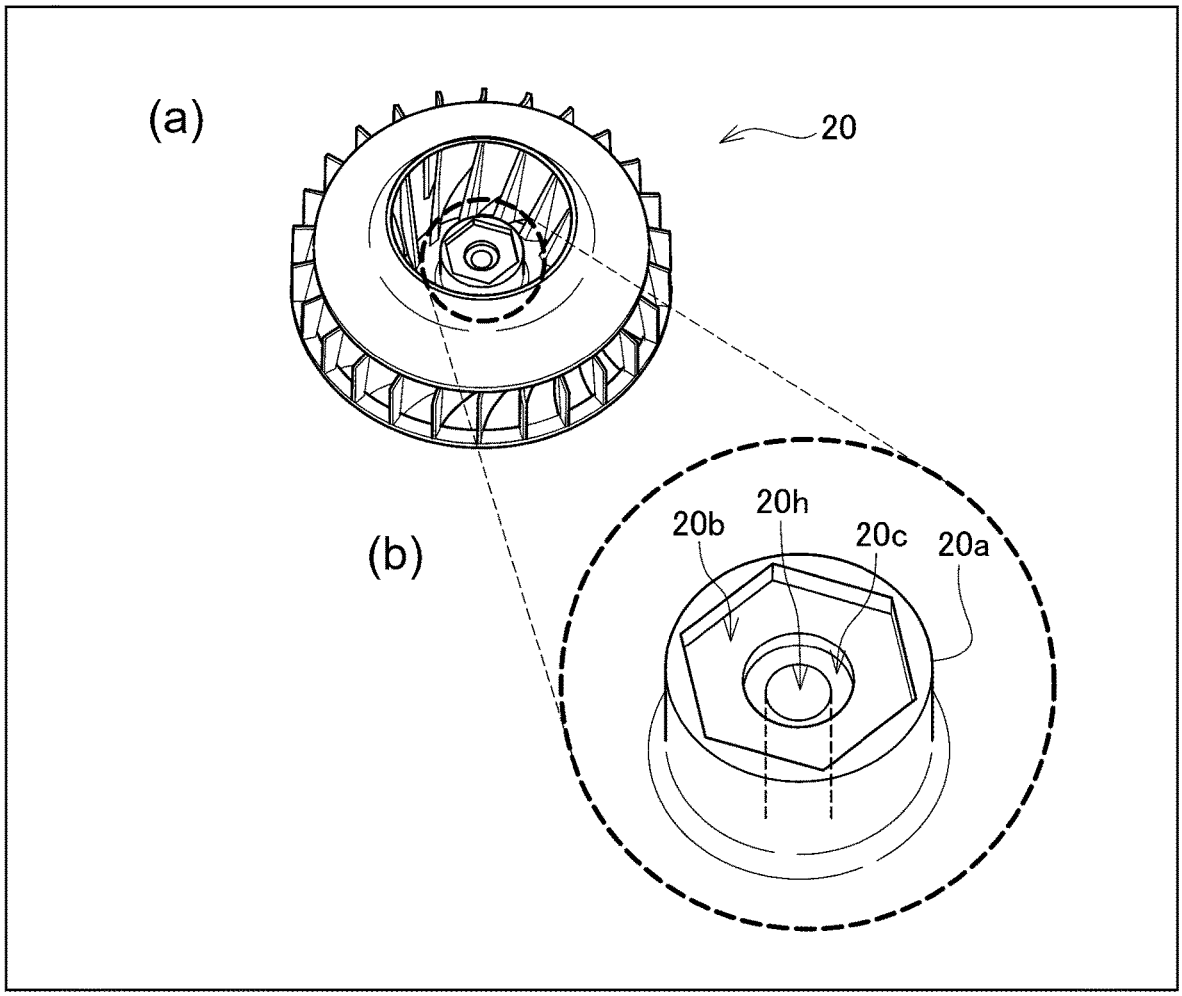
FIG. 4 is a perspective view of the impeller 20 showing the top end in detail, into which the vibration isolator 22 is fitted in the embodiment.

FIG. 4 is a diagram describing the top end of the impeller 20 in detail. A part (a) of FIG. 4 shows the entire shape of the impeller 20 viewed from above, and a part (b) of FIG. 4 shows the central portion of the impeller 20 viewed from above (area indicated by a thick and dotted line in the figure). As shown in the part (b) of FIG. 4, the impeller 20 has a cylindrical boss 20*a* at the center. The boss 20*a* has a through-hole 20*h* along its central axis. The boss 20*a* has a circular recess 20*c* on the top end surrounding the opening of its through-hole 20*h*. The circular recess 20*c* is coaxial with the through-hole 20*h*. The boss 20*a* further has a second recess 20*b* surrounding the recess 20*c*. The second recess 20*b* has the same size and the same polygonal shape as the vibration isolator 22.

Figure 5:
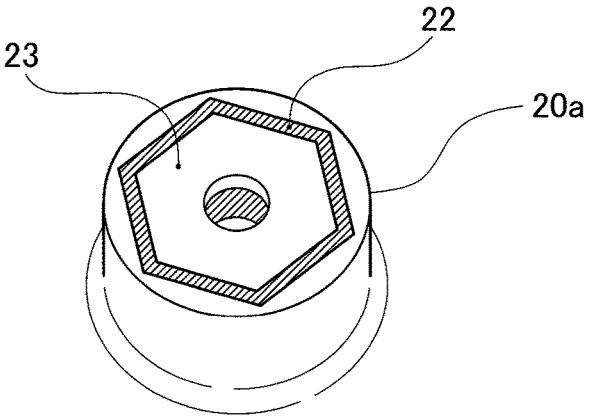
FIG. 5 is a diagram describing the vibration isolator 22 and the washer 23 fitted into the top end of the impeller 20.

As described above, the second recess 20*b* on the top surface of the boss 20*a* has the same size and the same polygonal shape as the vibration isolator 22, and the first recess 22*b* on the top surface of the vibration isolator 22 has the same size and the same polygonal shape as the washer 23. As shown in FIG. 5, the vibration isolator 22 fits in the second recess 20*b* of the boss 20*a*, and the washer 23 fits in the first recess 22*b* of the vibration isolator 22. The fitting protrusion 22*a* on the bottom surface of the vibration isolator 22 and the fitting protrusion 21*a* on the top surface of the bottom washer 21 shown in FIG. 1B have an important function which will be described in detail later.

Figure 6:
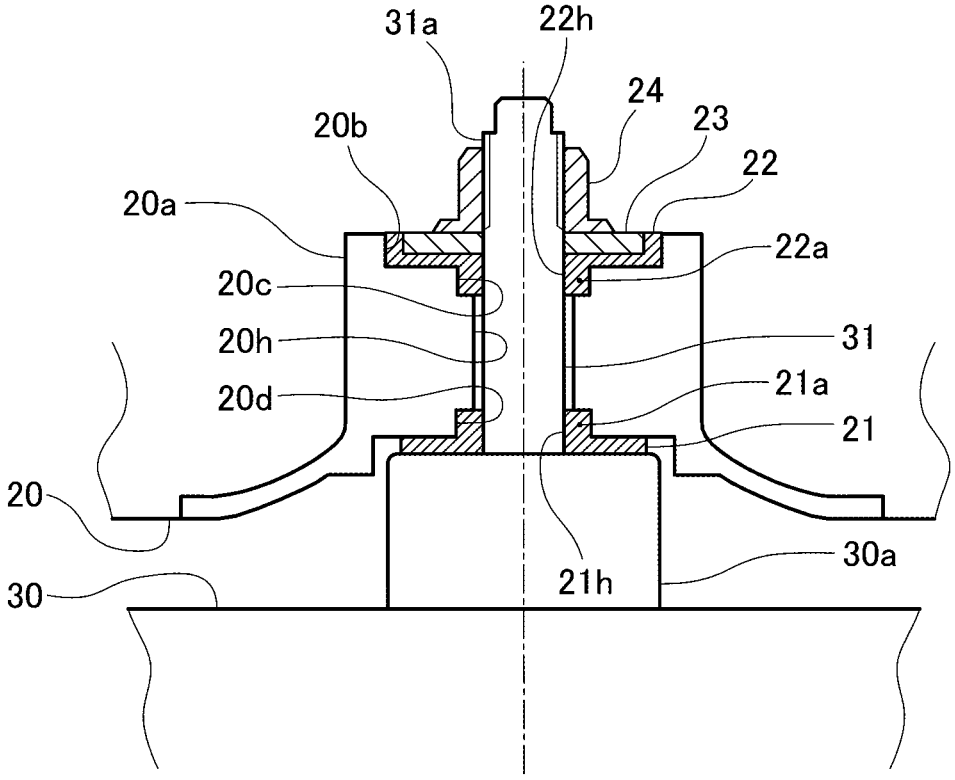
FIG. 6 is an enlarged cross-sectional view of the impeller 20 according to the embodiment mounted on a rotational shaft 31 of a motor 30.

FIG. 6 is an enlarged cross-sectional view of the impeller 20 according to the present embodiment mounted on the rotational shaft 31 of the motor 30. To mount the impeller 20, as illustrated, the rotational shaft 31 of the motor 30 is placed through the through-hole 20*h* along the central axis of the boss 20*a*. The impeller 20 is mounted on the distal end protruding from the through-hole 20*h*. The nut 24 is screwed with the distal end, with the vibration isolator 22 and the washer 23 in between.

The through-hole 20*h* has an inner diameter greater than the outer diameter of the rotational shaft 31 protruding from the motor 30 (typically greater by a radius of about 0.2 millimeters). The through-hole 22*h* of the vibration isolator 22 (refer to FIG. 3) has an inner diameter equal to the outer diameter of the rotational shaft 31. Thus, the outer peripheral surface of the rotational shaft 31 has no contact with the inner peripheral surface of the through-hole 20*h* of the boss 20*a*, but is in contact with the inner peripheral surface of the through-hole 22*h* of the vibration isolator 22. The cylindrical fitting protrusion 22*a* on the bottom surface of the vibration isolator 22 has an outer diameter equal to the inner diameter of the circular recess 20*c* on the top surface of the boss 20*a*. Thus, the outer peripheral surface of the fitting protrusion 22*a* of the vibration isolator 22 is in contact with the inner peripheral surface of the recess 20*c* of the boss 20*a*. The top end of the boss 20*a* is radially positioned with respect to the rotational shaft 31 using the outer peripheral surface and the inner peripheral surface of the fitting protrusion 22*a* (or specifically the through-hole 22*h*).

The same applies to the rubber bottom washer 21 on the bottom end of the boss 20*a*. As shown in the cross-sectional view in FIG. 6, the boss 20*a* has a circular recess 20*d* on the bottom end surrounding the opening of the through-hole 20*h*. The circular recess 20*d* is coaxial with the through-hole 20*h*. The bottom washer 21 has the cylindrical fitting protrusion 21*a* on its top surface (refer to FIG. 1B). The fitting protrusion 21*a* is fitted into the recess 20*d* of the boss 20*a*.

The through-hole 21*h* along the central axis of the fitting protrusion 21*a* of the bottom washer 21 has an inner diameter equal to the outer diameter of the rotational shaft 31. The fitting protrusion 21*a* of the bottom washer 21 has an outer diameter equal to the inner diameter of the recess 20*d* on the bottom end of the boss 20*a*. In this structure, the bottom end of the boss 20*a* is radially positioned with respect to the rotational shaft 31 using the outer peripheral surface and the inner peripheral surface of the fitting protrusion 21*a* (or specifically the through-hole 21*h*).

As described above, the boss 20*a* of the impeller 20 is radially positioned with respect to the rotational shaft 31 using its top recess 20*c* and its bottom recess 20*d*, the fitting protrusion 22*a* of the vibration isolator 22, and the fitting protrusion 21*a* of the bottom washer 21. The impeller 20, which is formed by injection molding and machining, can have the through-hole 20*h* and the recesses 20*c* and 20*d* accurately aligned on the central axis of the impeller 20 (and the boss 20*a*). The vibration isolator 22 and the bottom washer 21 are also formed by injection molding. At least the small fitting protrusions 22*a* and 21*a* can be formed accurately. The impeller 20 according to the present embodiment can thus be easily centered on (axially aligned with) the rotational shaft 31 with the bottom washer 21 and the vibration isolator 22.

With the impeller 20 and the rotational shaft 31 centered on each other, the washer 23 is fitted into the first recess 22*b* on the top surface of the vibration isolator 22. The nut 24 is screwed with the external thread 31*a* on the distal end of the rotational shaft 31 to mount the bottom washer 21, the impeller 20, and the vibration isolator 22 onto the rotational shaft 31 with the washer 23 in between. In this structure, although the rotational shaft 31 and the washer 23 are in solid contact with the nut 24 in between, the rubber vibration isolator 22 separates the impeller 20 from the washer 23. The vibration isolator 22 isolates the impeller 20 from the axial vibrations (slight axially reciprocating vibrations of the rotational shaft of the motor) and the rotational vibrations (vibrations caused by slight changes in torque of the motor per rotation of the rotational shaft) in the motor 30, and thus reduces these vibrations propagating to the impeller 20.

As shown in FIG. 5, the second recess 20*b* on the top surface of the boss 20*a* and the washer 23 have the rubber vibration isolator 22 between them. The second recess 20*b* and the washer 23 are both polygonal. The torque caused by the motor 30 is thus transmitted to the washer 23 through the rotational shaft 31 and the nut 24, and to the impeller 20 as a force of the polygonal washer 23 for compressing the rubber vibration isolator 22. The torque of the motor 30, which is transmitted to the impeller 20 as a force of the washer 23 for compressing the vibration isolator 22 as described above, is thus efficiently transmitted to the impeller 20 through the rubber vibration isolator 22 without solid contact between the washer 23 and the impeller 20.

Additionally, the washer 23 according to the present embodiment is larger than the size to mount the impeller 20 with the vibration isolator 22. More specifically, as described with reference to FIGS. 2A and 2B, the washer 23 has the polygonal shape with the through-hole 23*h* at the center and the multiple (six in the present embodiment) projections radially extending from the circumference drawn with a radius equal to or greater than two and half times (or three times in some embodiments) the radius of through-hole 23*h*. Thus, the polygonal washer 23 has a longer circumference in contact with the vibration isolator 22, and thus has a greater area for compressing the rubber vibration isolator 22 to transmit the torque of the motor 30. This structure transmits a greater torque while applying less stress to the rubber vibration isolator 22. Thus, the vibration isolator 22 can absorb any greater rotational vibrations in the motor 30.

Figure 7:
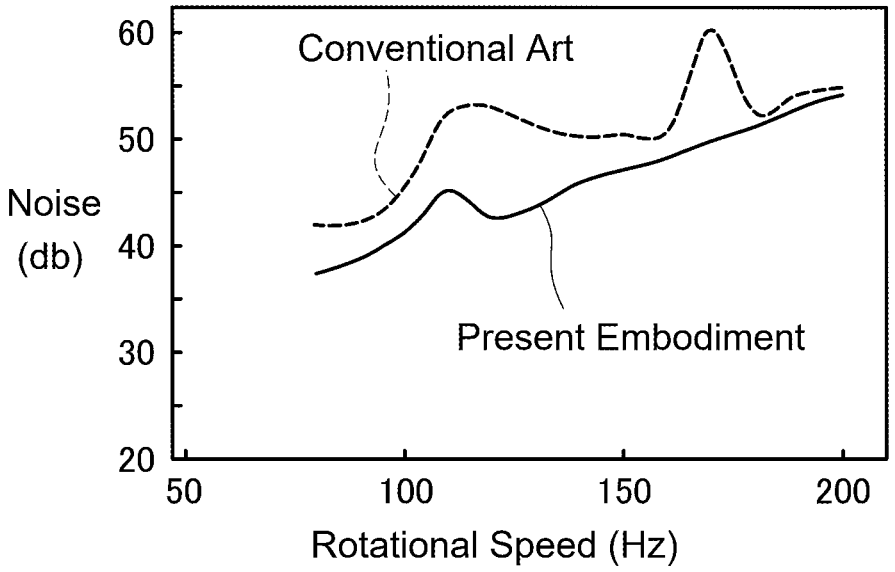
FIG. 7 is a graph showing the measurement results of noise reduction achieved by the blower fan 1 according to the embodiment.

FIG. 7 is a graph showing the measurement results of noise reduction achieved by the blower fan 1 according to the present embodiment. The results shown in FIG. 7 are obtained by actually measuring noise of the impeller 20 at different rotational speeds. In the graph, the solid line indicates the actual measurement results for the blower fan 1 according to the present embodiment, and the dotted line indicates the actual measurement results for the impeller 20 mounted without the rubber bottom washer 21 or the vibration isolator 22. The results reveal that the blower fan 1 according to the present embodiment reduces noise over a wide range of rotational speeds.

The washer 23 is polygonal in the above embodiment. In this case, the first recess 22*b* of the vibration isolator 22 for receiving the washer 23 and the vibration isolator 22 are polygonal. The second recess 20*b* on the top end of the impeller 20 is also polygonal. The washer 23 is polygonal to transmit the torque of the motor 30 to the impeller 20 as a force for compressing the rubber vibration isolator 22. In some embodiments, the washer 23 may be in any other shape that transmits the torque of the motor 30 to the impeller 20 as a force for compressing the rubber vibration isolator 22.

Figure 8A:
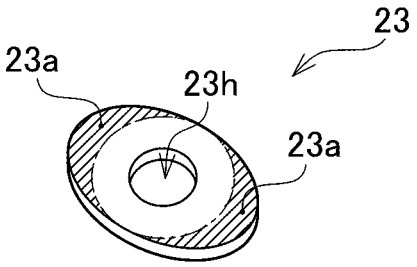
FIGS. 8A and 8B are diagrams describing the washer 23 used for blower fans 1 according to modifications.

FIG. 8A shows a washer 23 that is oval. The oval washer 23 may have a central through-hole 23*h* and two projections 23*a* (hatched in the figure) facing each other across the through-hole 23*h* and radially extending from a circumference (indicated by a dot-and-dash line in the figure) drawn with a radius equal to or greater than two and half times (or three times in some embodiments) the radius of the through-hole 23*h*. In this modification, the first recess 22*b* of the vibration isolator 22 for receiving the washer 23 and the vibration isolator 22 are oval. The second recess 20*b* on the top end of the impeller 20 is also oval.

Figure 8B:
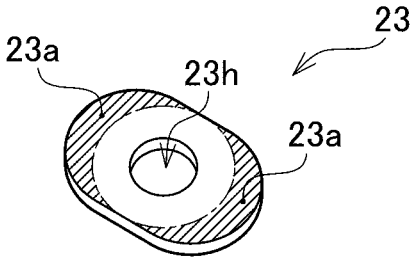

FIG. 8B shows a washer 23 that is long oval. The long oval washer 23 may have a central through-hole 23*h* and two projections 23*a* (hatched in the figure) facing each other across the through-hole 23*h* and radially extending from a circumference (indicated by a dot-and-dash line in the figure) drawn with a radius equal to or greater than two and half times (or three times in some embodiments) the radius of the through-hole 23*h*. In this modification, the first recess 22*b* of the vibration isolator 22 for receiving the washer 23 and the vibration isolator 22 are long oval. The second recess 20*b* on the top end of the impeller 20 is also long oval.

Although the blower fan 1 according to the embodiment and the modifications have been described above, the invention is not limited to the above embodiments. The present invention may be modified in various manners without departing from the scope and the spirit of the invention.

REFERENCE SIGNS LIST

1 blower fan
10 body case
20 impeller
20*a* boss
20*b* second recess
20*c* recess
20*d* recess
20*h* through-hole
21 bottom washer
21*a* fitting protrusion
21*h* through-hole
22 vibration isolator
22*a* fitting protrusion
22*b* first recess
22*h* through-hole
23 washer
23*a* projection
23*h* through-hole
24 nut
30 motor
31 rotational shaft
31*a* external thread

The invention claimed is:

1. A blower fan for blowing air by rotating an impeller with a motor, the blower fan comprising: an impeller having a through-hole along a central axis; a motor including a rotational shaft placed through the through-hole; a washer receiving the rotational shaft protruding from the through-hole; and a fastener mounted on the rotational shaft and pressing the impeller through the washer to mount the impeller on the rotational shaft, wherein the washer is a plate having a predetermined shape including a plurality of projections radially extending from a circumference about a receiving hole through which the rotational shaft is placed, the washer and the impeller are separated by an elastic vibration isolator, the vibration isolator has a plurality of projections radially extending from a circumference, the vibration isolator has a first recess on a top surface of the vibration isolator, the first recess having a shape that matches an outer shape of the washer such that the washer is fitted into the first recess, the impeller has a second recess on a top surface of the impeller, the second recess having a shape that matches an outer shape of the vibration isolator such that the vibration isolator is fitted into the second recess, and wherein in a state where the washer is fitted into the first recess and the vibration isolator is fitted into the second recess: an outer side surface of the washer facing away from the central axis faces an inner side surface of the second recess with the vibration isolator therebetween; and on a plane including a section plane of the washer perpendicular to the central axis, the second recess and the washer have a same shape and different sizes.

2. The blower fan according to claim 1, wherein the circumference about the receiving hole has a radius equal to or greater than two and one half times a radius of the receiving hole.

3. The blower fan according to claim 2, wherein the impeller mounted on the rotational shaft has a top end supported by the vibration isolator and a bottom end supported by a rubber bottom washer.

4. The blower fan according to claim 3, wherein the washer is polygonal.

5. The blower fan according to claim 3, wherein the washer is shaped as an oval.

6. The blower fan according to claim 2, wherein the washer is polygonal.

7. The blower fan according to claim 2, wherein the washer is shaped as an oval.

8. The blower fan according to claim 1, wherein the impeller mounted on the rotational shaft has a top end supported by the vibration isolator and a bottom end supported by a rubber bottom washer.

9. The blower fan according to claim 8, wherein the washer is polygonal.

10. The blower fan according to claim 8, wherein the washer is shaped as an oval.

11. The blower fan according to claim 1, wherein the washer is polygonal.

12. The blower fan according to claim 1, wherein the washer is shaped as an oval.

* * * * *